US005427706A

United States Patent [19]

Kobayashi et al.

[11] Patent Number: 5,427,706

[45] Date of Patent: Jun. 27, 1995

[54] ELECTROVISCOUS FLUIDS CONTAINING METAL SULFONATE FUNCTIONAL ORGANOPOLYSILOXANES

[75] Inventors: Akihiko Kobayashi; Takashi Nakamura, both of Chiba, Japan

[73] Assignee: Dow Corning Toray Silicon Co., Ltd., Tokyo, Japan

[21] Appl. No.: 113,455

[22] Filed: Aug. 27, 1993

[30] Foreign Application Priority Data

Aug. 28, 1992 [JP] Japan ..... 4-254208
Aug. 31, 1992 [JP] Japan ..... 4-255825

[51] Int. Cl.[6] ..... C10M 171/00; C10M 169/04

[52] U.S. Cl. ..... 252/78.3; 252/73; 252/572

[58] Field of Search ..... 556/428; 252/572, 78.3, 252/73, 75

[56] References Cited

U.S. PATENT DOCUMENTS 3,047,507 7/1962 Winslow ..... 252/75
3,215,643 11/1965 Pail ..... 556/428
4,645,614 2/1987 Goossens et al. ..... 252/75
5,068,380 11/1991 Meguriya et al. ..... 556/428
5,210,249 5/1993 Hager et al. ..... 556/428

FOREIGN PATENT DOCUMENTS 180238 7/1989 Japan .
1262942 10/1989 Japan .

*Primary Examiner*—Christine Skane
*Attorney, Agent, or Firm*—Timothy J. Troy

[57] ABSTRACT

The present invention relates to an electroviscous fluid comprising the dispersion in an electrical insulating fluid of an organopolysiloxane having at least one metal sulfonate group in its molecule. The electroviscous fluid of the present invention can further comprise a polyether. The electroviscous fluid of the present invention does not wear or abrade surrounding equipment, is thermally stable, and that has a large electroviscous effect (yield value) and an excellent dispersion stability.

15 Claims, No Drawings

ELECTROVISCOUS FLUIDS CONTAINING METAL SULFONATE FUNCTIONAL ORGANOPOLYSILOXANES

BACKGROUND OF THE INVENTION

The present invention relates to an electroviscous fluid which is a fluid whose viscosity can be changed by varying an externally applied electric voltage. More particularly, the present invention relates to a thermally stable electroviscous fluid whose yield value is substantially increased by small voltages, which strongly resists particle sedimentation, and which does not wear or abrade surrounding equipment.

Fluids whose viscosity can be varied by the application of an external voltage can be used, for example, for power transfer, for shock absorption, and as valves, and as result such fluids have recently been the subject of some scrutiny. Fluids whose viscosity increases in response to an electrical field are collectively known as electroviscous fluids. However, in order to be able to withstand highly practical applications in, for example, clutches, engine mounts, and shock absorbers, an electroviscous fluid is required whose yield value is substantially increased by the application of small voltages.

Various types of such fluids have already been proposed. These have generally taken the form, for example, of dispersions of porous inorganic particles (e.g., silica, alumina, talc, etc.) in electrical insulating fluids. Electroviscous fluids are produced by dispersing in an electrical insulating fluid a particle having an electric double layer due to water being absorbed on the particle surface, the particles then orient in response to an external electrical field and the viscosity increases (more specifically, the fluid converts into a Bingham fluid and exhibits a yield value). This effect is hereinafter referred to as the Winslow effect. Based on the substantial practical advantages offered by silica (ease of industrial acquisition, rich potential for improvements and modifications in quality, etc.), many electroviscous fluids have been proposed that use silica in the system such as the fluids disclosed in U.S. Pat. No. 3,047,507 to Winslow and in Japanese Patent Application Laid Open [Kokai or Unexamined] No. 61-44998 [44,998/86]. However, these particular electroviscous fluids do not perform satisfactorily in industrial applications because they abrade the surrounding equipment, suffer from particle sedimentation, and exhibit a Winslow effect of modest degree.

In order to improve upon these deficiencies, electroviscous fluids have been proposed that comprise a dispersion of a polyelectrolyte in an electrical insulating fluid. The term polyelectrolyte collectively denotes polymeric compounds that contain ion pairs within the structure. Many natural and synthetic polyelectrolytes are known, and the ion-exchange resins are the best known. For example, Japanese Patent Application Laid Open No. 1-180238 [180,238/89] discloses an electroviscous fluid that comprises a dispersion in an electrical insulating fluid of microparticles of a polyelectrolyte that contains amine salt structures. Japanese Patent Application Laid Open No. 1-262942 [262,942/89] discloses an electroviscous fluid that comprises a dispersion in an electrical insulating fluid of particles prepared by pulverizing an ion-exchange resin. There are several advantages associated with the use of such polyelectrolyte particles such as that since the particles are made of organic polymer, (a) they have a small specific gravity and thus resist sedimentation, (b) they have little abrasiveness for surrounding equipment, and (c) they provide a relatively large Winslow effect. Another advantage associated with synthetic polyelectrolytes is that the particle can be freely engineered.

However, the preparation of polyelectrolyte particle-based electroviscous fluids as known in the art involves solidification of the electrolyte through three-dimensional crosslinking by some methodology followed by the preparation of microparticles by, for example, pulverization. In this approach, the three-dimensional configuration of the electrolyte is locked in at the point of synthesis and the electrolyte can then no longer be reworked. Another deficiency in this approach is that the microparticulation process cannot produce perfectly spherical particles, and this in turn precludes both a satisfactory dispersion stability and a satisfactory Winslow effect. In addition, all of the polyelectrolyte particles proposed to date are carbon-based. Silicone oil as described below is the best electrical insulating fluid (dispersion medium), however, carbon-based particles have a poor affinity for silicone oil.

SUMMARY OF THE INVENTION

The instant invention relates to an electroviscous fluid that comprises the dispersion in an electrical insulating fluid of a microparticulate polyelectrolyte that is comprised of a organopolysiloxane that contains a metal sulfonate group. The instant invention further relates to an electroviscous fluid that comprises the dispersion in an electrical insulating fluid of a microparticulate polyelectrolyte that is comprised of a mixture of a polyether and an organopolysiloxane that contains a metal sulfonate group.

An object of the present invention is the introduction of an electroviscous fluid that provides a high electroviscous effect (yield value), has a good dispersion stability, and does not abrade or wear the surrounding equipment. It is another object of the present invention to provide an electroviscous fluid which is thermally stable at high temperatures (100° C. and above).

These and other features, objects and advantages of the present invention will be apparent upon consideration of the following detailed description of the invention.

DETAILED DESCRIPTION OF THE INVENTION

Thus the present invention relates to an electroviscous fluid composition comprising (I) an electrical insulating fluid; and (II) an organopolysiloxane having at least one metal sulfonate group in its molecule. The metal sulfonate-containing organopolysiloxane used by the present invention acts as a polyelectrolyte, and this component is essential for obtaining a high Winslow effect and a stable particle dispersion while avoiding wear or abrasion of the surrounding equipment. This metal sulfonate-containing organopolysiloxane is exemplified by a metal sulfonate-containing organopolysiloxane having the following unit formula $$(R^1SiO_{3/2})_l(R^1{}_2SiO)_m\overset{\overset{R^2SO_3X_{1/n}}{|}}{(SiO_{3/2})_p}-\overset{\overset{R^2SO_3X_{1/n}}{|}}{\underset{\underset{R^1}{|}}{(SiO)_q}}$$

wherein $R^1$ is $C_{1-20}$ alkyl or aryl, $R^2$ is $C_{1-20}$ alkylene, X is a monovalent or divalent metal ion, l, m, p, and q are zero or greater than zero, and n is 1 or 2, with the proviso that p and q cannot simultaneously be zero. This organopolysiloxane can be prepared by a variety of synthetic methods. A method that recommends itself for its ease and reliability consists of (i) the preliminary synthesis of monomer (or polymer with low degree of polymerization (DP)) that contains both a silanol group and specified substituent(s), followed by (ii) silanol condensation simultaneous with particle formation. The metal sulfonate group itself can be introduced by various methods, and the method of introduction is not specifically restricted. A typical example of the introduction of a metal sulfonate group comprises metal sulfonation by the reaction between the epoxy ring and a metal sulfite (the metal being a monovalent or divalent metal ion) in water at around 60° C. to 80° C. The chain terminating units of the metal sulfonate containing organopolysiloxanes of this invention are units having the formula $R_3SiO_{\frac{1}{2}}$ wherein R is a hydroxyl group or a monovalent hydrocarbon radical having from 1 to 20 carbon atoms such as methyl, ethyl, and propyl.

This organopolysiloxane has the following characteristic features: (i) a large Winslow effect is made possible because the metal sulfonate group density can be increased, (ii) when the trifunctional siloxane unit is present, the organopolysiloxane has a three-dimensional structure, which makes possible the formation of high-density particles which in turn inhibits the infiltration of water into the particles and produces high-specific-gravity dispersions which have favorable use characteristics and, (iii) a strong ionic crosslinking develops due to the presence of the metal sulfonate group. As a result, a solid can be obtained even in the absence of the trifunctional siloxane unit, but the organopolysiloxane also remains soluble in water and polar organic solvents. Therefore, this organopolysiloxane can exhibit the physical properties of a solid in any process state while at the same time it can also be relatively freely subjected to primary and secondary processing.

No specific restrictions apply to the structure or composition of the metal sulfonate-containing organopolysiloxane polyelectrolyte prepared as described above, however, relatively good Winslow effects are obtained when the following conditions are met. While the metal sulfonate-free alkyl(or aryl)siloxane unit is optional, the particulated electrolyte will exhibit an excellent affinity for the electrical insulating fluid when this unit is present. However, the contribution by the salt structure is diminished with an increasing proportion of alkyl(or aryl)siloxane unit, with the result being that the Winslow effect becomes attenuated and the particle production process is made more difficult because the water solubility of the electrolyte is reduced. The ratio between the number of alkyl(or aryl)siloxane units and the number of metal sulfonate-containing units must therefore fall within an optimal range. With regard to the neutralization equivalency used for formation of the metal sulfonate, larger values for this parameter result in an increased water solubility for the electrolyte and a larger Winslow effect, and larger values for this parameter are therefore preferred. However, when this value exceeds 1, the excess base not only creates the potential for decomposition or alteration of the various materials making up the electroviscous fluid, but also causes performance problems for the electroviscous fluid itself, such as high current density and dielectric breakdown. The neutralization equivalency must therefore be held strictly to $\leqq 1$.

The metal sulfonate-containing organopolysiloxane microparticles used in the present invention are solids in all cases and have the form of a micropowder. The particle diameter of these microparticles is not specifically restricted, but average particle diameters below 100 micrometers are generally preferred because they afford an excellent dispersibility. As outlined above, after preparation of an aqueous solution of polyelectrolyte in the form of the silanol-containing monomer or low-DP polymer, the polymerized microparticles can be obtained by developing silanol group condensation simultaneous with particle formation by, for example, spray drying this solution. This approach of course makes possible control of the morphology and size of the particles, and water content. A significant characteristic feature occurs when the resulting polymer does not contain the trifunctional siloxane unit and the metal ion is a monovalent ion, the polymer is then water soluble and wide latitude is available for secondary processing. When the metal ion includes a divalent ion, the water solubility of the polyelectrolyte, in the form of the silanol-containing monomer or low-DP polymer, declines as the proportion of divalent ion increases, and a complete absence of solubility in water occurs when the divalent ion reaches 100%. However, particle formation by such methods as spray drying remains possible since aqueous suspensions can be formed at concentrations of about 20 weight % for divalent ion percentages up to about approximately 75 weight %.

The present invention further relates to an electroviscous fluid composition comprising (I) an electrical insulating fluid; (II) an organopolysiloxane having at least one metal sulfonate group in its molecule, and (III) a polyether. Thus the dispersed phase of the present invention can comprise a mixture of the above described organopolysiloxane and a polyether, this mixture is then dispersed into the electrical insulating fluid described hereinbelow.

The structure of the polyether used in the compositions of the present invention preferably contains the oxyalkylene unit, for example, oxyethylene, oxypropylene, etc., and this polyether may be linear or branched. No particular restriction applies to its terminal groups, nor is its molecular weight specifically restricted. However, polyethers terminated by alkyl groups have significantly lower boiling points than the hydroxyl-terminated polyethers, and molecular weights below 100 should be avoided in particular because they are incongruous with the goal of thermal stability, which is one object of the present invention, and can migrate from the particle interior after formulation into the electroviscous fluid. On the other hand, even very high molecular weights will be unproblematic as long as the polyether and the above-described electrolyte can be mixed to homogeneity using water or the like in the stage prior to particle production. However, a highly crosslinked polyether is disadvantageous as a medium for the electrolyte due to the associated low ionic dissociation and weak ion transport activity.

With regard to the function of this polyether, it promotes dissociation of the ion pairs in the polyelectrolyte and thereby supports the development of a large Winslow effect. In addition, unlike low-volatility substances such as water, it does not escape from the system even at high temperatures, and it thereby functions to equip the electroviscous fluid with heat resistance. No particular restriction applies to the method for adsorption to the polyelectrolyte, but an efficient and reliable method consists of dissolution of the polyether and polyelectrolyte in water and spray drying this solution. Nor do specific restrictions apply to the adsorption quantity, but adsorption quantities on the level of 1 weight % to 30 weight % are preferred. The basis for this range is that no promotion of the Winslow effect is noted at below 1%, while polyether escapes at more than 30% and causes a high current density.

Many methods are available for preparation of the microparticles comprising a mixture of polyether and the metal sulfonate-containing organopolysiloxane used by the present invention. In one method, the above-described metal sulfonate-containing organopolysiloxane and polyether are dissolved in water, this aqueous solution is sprayed into a hot gas, and microparticles are formed by drying while in the spray state. This method, known as spray drying, is a general method for converting polymeric compounds into microparticles.

The electroviscous fluid of the present invention consists of a dispersion in an electrical insulating fluid of microparticles of metal sulfonate-containing organopolysiloxane as described above, or a mixture of a polyether and the metal sulfonate-containing organopolysiloxane described above. This electrical insulating fluid may be any electrical insulating fluid that is electrically insulating and a liquid at ambient temperature, but is not otherwise restricted as to type, etc. Operable electrical insulating fluids are exemplified by mineral oils, dibutyl sebacate, chloroparaffins, fluorine oils, and silicone oils. Among the preceding examples of electrical insulating fluids, silicone oils are preferred for their high electrical insulation, low variation in viscosity due to temperature, and so forth. The silicone oil is preferably a diorganopolysiloxane oil having the general formula:

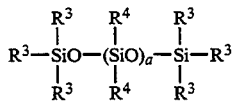

wherein $R^3$ and $R^4$ are monovalent hydrocarbon groups, for example, alkyl groups such as methyl, ethyl, propyl, etc., and aryl groups such as phenyl, naphthyl, etc., as well as substituted hydrocarbon groups comprising the preceding partially substituted by fluorine, chlorine, amino, nitro, epoxy, etc. Among these groups, methyl preferably comprises at least 30 mole % of $R^3$ and $R^4$ from the standpoints of economics and material acquisition. The degree of polymerization a is not specifically restricted, but a preferably does not exceed 1,000 and more preferably does not exceed 100 in order for the viscosity to fall within practical ranges. Diorganopolysiloxane oils with such chemical structures are known as silicone oils and are available as various commercial products, for example, SH200 from Dow Corning Toray Silicone Company, Limited. Among the diorganopolysiloxane oils as described above, diorganopolysiloxanes in which fluoroalkyl comprises a portion of $R^3$ and $R^4$ are preferred for their ability to bring about higher Winslow effects and prevent particle sedimentation due to specific gravity differences. The chemical structure of this fluoroalkyl group is not specifically restricted, but fluoroalkyl groups having no more than 10 carbons are preferred based on ease of synthesis, etc., and gamma,gamma,gamma-trifluoropropyl is particularly preferred. Moreover, in order to obtain a substantial promotion of the Winslow effect, the fluoroalkyl content is preferably at least 30 mole %. The mechanism by which the fluoroalkyl group enhances the Winslow effect is unclear. However, the following can be hypothesized: a strong intramolecular dipole is generated because both electronegative fluorine and electropositive silicon are present within the molecule separated by a suitable distance, and contact between this dipole and the dispersed particle promotes the particle's internal polarization. In addition, since a fluorine-containing fluid tends to have an increased specific gravity, such a liquid simultaneously functions to inhibit particle sedimentation. Such fluoroalkyl-containing diorganopolysiloxanes are available as various commercial products, for example, FS1265 from Dow Corning Toray Silicone Company, Limited.

The electroviscous fluid in accordance with the present invention comprises the dispersion of polyelectrolyte particles as described above in electrical insulating fluid as described above. The quantity of dispersion preferably falls within the range of 0.1 to 50 weight % and more preferably within the range of 10 to 40 weight %. A satisfactory viscosity increase is not obtained at below 0.1 weight %. On the other hand, at values in excess of 50 weight %, the viscosity of the system is increased to such a substantial degree that practical applications are precluded. The electroviscous fluid of the present invention as described hereinbefore is useful as a working or hydraulic oil, etc., in machinery, tools, and instruments that are specifically used at temperatures from ambient temperatures to temperatures of about 100° C.

The present invention also relates to a device employing an electroviscous fluid, the improvement comprising using as the electroviscous fluid an electroviscous fluid composition comprising (I) an electrical insulating fluid, and (II) an organopolysiloxane having at least one metal sulfonate group in its molecule. This electroviscous composition can further comprise a polyether. The electroviscous fluid, metal sulfonate containing organopolysiloxane, and polyether are as described above, including preferred amounts and embodiments thereof.

The present invention is explained in greater detail below through illustrative and comparison examples, in which the physical property values were measured at 25° C. The electroviscosity was measured as follows. The test fluid was placed in an aluminum cup (inside diameter=42 mm), and an aluminum rotor (diameter=40 mm, length=60 mm) was then inserted into the cup. With this cylindrical cell set upright, the cup was linearly accelerated over 40 seconds from a shear rate (D) of zero to 330 $s^{-1}$. During this period, the torque applied to the rotor was detected by a torque sensor and was converted into shear stress (S), and a D-versus-S curve was drawn on an XY recorder. The rotor was then electrically grounded, a direct-current voltage was applied to the cup, and another D-versus-S curve was constructed in the same manner as before. The linear segment was extrapolated to the S axis, and this was designated as the yield value at the particular field strength.

Example 1

10.0 g 3-glycidoxypropyltrimethoxysilane and 5.33 g sodium sulfite were introduced into 15 g pure water and reacted by stirring for 2 hours at 75° C. The reaction mixture was introduced into 100 mL stirred acetone and a white precipitate was obtained. This white precipitate was isolated and analyzed and was confirmed to be an organosilicon compound (monomer (1)) having the following structure:

monomer (1)

$$(HO)_3Si(CH_2)_3OCH_2\underset{\underset{OH}{|}}{CH}-CH_2SO_3Na$$

Monomer (1) was found to be relatively stable in aqueous solution. Infrared absorption spectroscopy confirmed that monomer (1) contained a salt structure ($-SO_3^-Na^+$), that is, that the desired polyelectrolyte had been obtained. An aqueous polyelectrolyte solution was prepared by diluting monomer (1) to the 30 weight % aqueous solution. Condensation polymerization and particle formation were conducted simultaneously by spray drying this aqueous solution under the following conditions:

spray formation: atomizer method
air pressure: 1.5 kg/cm$^2$
temperature at spray point: approximately 200° C.
temperature at collection point: approximately 100° C.

Approximately 15 g of a powder was obtained as the result of feeding 100 g of the aqueous polyelectrolyte solution over a period of approximately 10 minutes. This powder was confirmed by microscopic observation to be spherical with an average particle diameter of approximately 2 to 3 micrometers (water content=approximately 5%). Immediately after spray drying, this powder was physically dispersed to homogeneity at a concentration of 33 weight % in dimethylpolysiloxane oil (SH200-20CS from Dow Corning Toray Silicone Company, Limited) to afford a dispersion designated as the electroviscous fluid. When this electroviscous fluid was allowed to stand at room temperature, 4 to 5 days were required for the solids to begin to sediment, which confirmed the dispersion stability to be relatively good. The electroviscosity of this electroviscous fluid was measured with the following results: yield value=135 Pa at a field strength of 1 kV/mm, yield value=195 Pa at a field strength of 2 kV/mm. The current density at a 1 kV/mm field strength was extremely low (approximately 10 nA/cm$^2$). In addition, the cup filled with this electroviscous fluid was subjected to continuous rotation at a constant shear rate of 300 s$^{-1}$for 24 hours, and the fluid was then drained off. In terms of appearance, no trace of abrasion was observed on either item when the aluminum rotor and cup were inspected visually. These measurement results are summarized in Table I.

Example 2

Immediately after spray drying, polyelectrolyte powder obtained as in Example 1 was physically dispersed to homogeneity at a concentration of 33 weight % in methyl(gamma, gamma, gamma-trifluoropropyl)-polysiloxane oil (FS1265-300CS from Dow Corning Toray Silicone Company, Limited) to afford a dispersion designated as the electroviscous fluid. When this electroviscous fluid was allowed to stand at room temperature, approximately 1 month was required for the solids to begin to sediment, which confirmed the dispersion stability to be very good. The electroviscosity of this electroviscous fluid was measured with the following results: yield value=310 Pa at a field strength of 1 kV/mm, yield value=525 Pa at a field strength of 2 kV/mm. The current density at a 1 kV/mm field strength was extremely low (approximately 20 nA/cm$^2$). In addition, the cup filled with this electroviscous fluid was subjected to continuous rotation at a constant shear rate of 300 s$^{-1}$ for 24 hours, and the fluid was then drained off. In terms of appearance, no trace of abrasion was observed on either item when the aluminum rotor and cup were inspected visually. These measurement results are summarized in Table I.

Example 3

10.0 g 3-glycidoxypropyltrimethoxysilane and 5.08 g calcium sulfite were introduced into 15 g pure water and reacted by stirring for 2 hours at 75° C. The reaction mixture was introduced into 100 mL stirred acetone and a white precipitate was produced. This white precipitate was isolated and analyzed and was confirmed to be an organosilicon compound (monomer (2)) having the following structure:

monomer (2)

$$[(HO)_3Si(CH_2)_3OCH_2\underset{\underset{OH}{|}}{CH}-CH_2SO_3]_2Ca$$

Monomer (2) had a fairly poor water solubility, but its suspension in water was relatively stable. Infrared absorption spectroscopy confirmed that monomer (2) contained a salt structure ($[-SO_3^-]_2Ca^{2+}$), that is, that the desired polyelectrolyte had been obtained. A 30 weight % aqueous suspension of monomer (2) was prepared and then spray dried under the same conditions as in Example 1. Approximately 15 g of a powder was obtained as the result of feeding 100 g of the polyelectrolyte suspension over a period of approximately 10 minutes. This powder was confirmed by microscopic observation to be spherical with an average particle diameter of approximately 5 micrometers (water content=2.5%).

Immediately after spray drying, this powder was physically dispersed to homogeneity at a concentration of 33 weight % in dimethylpolysiloxane oil (SH200-20CS from Dow Corning Toray Silicone Company, Limited) to afford a dispersion designated as the electroviscous fluid. When this electroviscous fluid was allowed to stand at room temperature, 4 to 5 days were required for the solids to begin to sediment, which confirmed the dispersion stability to be relatively good. The electroviscosity of this electroviscous fluid was measured with the following results: yield value=130 Pa at a field strength of 1 kV/mm, yield value=180 Pa at a field strength of 2 kV/mm. The current density at a 1 kV/mm field strength was extremely low (approximately 2 nA/cm$^2$). In addition, the cup filled with this electroviscous fluid was subjected to continuous rotation at a constant shear rate of 300 s$^{-1}$ for 24 hours, and the fluid was then drained off. In terms of appearance, no trace of abrasion was observed on either item when the aluminum rotor and cup were inspected visually. These measurement results are summarized in Table I.

Comparison Example 1

A wet-method silica (Nipsil VN3 from Nippon Silica Kogyo Kabushiki Kaisha) with an average particle size of 18 micrometers was physically dispersed to homogeneity at a concentration of 15 weight % in dimethylpolysiloxane oil (SH200-20CS from Dow Corning Toray Silicone Company, Limited) to afford a dispersion designated as the electroviscous fluid. When this electroviscous fluid was allowed to stand at room temperature, only several hours were required for the solids to begin to sediment. The dispersion stability was therefore rated as poor. The electroviscosity of this electroviscous fluid was measured with the following results: yield value=65 Pa at a 1 kV/mm field strength and yield value=105 Pa at a 2 kV/mm field strength. The current density was approximately 85 nA/cm$^2$ at a 1 kV/mm field strength. In addition, the cup filled with this electroviscous fluid was subjected to continuous rotation at a constant shear rate of 300 s$^{-1}$ for 24 hours, and the fluid was then drained off. When the aluminum rotor and cup were examined, several wear streaks were observed extending along the direction of rotation. These measurement results are summarized in Table 1.

Comparison Example 2

A weakly acidic spherical acrylic cation-exchange resin (Amberlite IRC-76 from Organo Kabushiki Kaisha) was physically dispersed to homogeneity at a concentration of 10 weight % in dimethylpolysiloxane oil (SH200-20CS from Dow Corning Toray Silicone Company, Limited) to afford a dispersion that was designated as the electroviscous fluid. When this electroviscous fluid was allowed to stand at room temperature, only several hours were required for the solids to begin to sediment. The dispersion stability was therefore rated as poor. The electroviscosity of this electroviscous fluid was measured with the following results: yield value=3 Pa at a 1 kV/mm field strength and yield value=12 Pa at a 2 kV/mm field strength. The current density was approximately 2 nA/cm$^2$ at a 1 kV/mm field strength. In addition, the cup filled with this electroviscous fluid was subjected to continuous rotation at a constant shear rate of 300 s$^{-1}$ for 24 appearance, no trace of abrasion was observed on either item when the aluminum rotor and cup were inspected. These measurement results are summarized in Table I below.

TABLE I

| | Yield Value (Pa) | | Dispersion | |
|---|---|---|---|---|
| | 1 kV/mm | 2 kV/mm | Stability | Abrasion |
| Example 1 | 135 | 195 | excellent | none |
| Example 2 | 310 | 525 | excellent | none |
| Example 3 | 130 | 180 | excellent | none |
| Comparison Example 1 | 65 | 105 | poor | present |
| Comparison Example 2 | 3 | 12 | poor | none |

Example 4

10.0 g 3-glycidoxypropyltrimethoxysilane and 5.33 g sodium sulfite were introduced into 15 g pure water and reacted by stirring for 2 hours at 75° C. The reaction mixture was introduced into 100 mL stirred acetone and a white precipitate was obtained. This white precipitate was isolated and analyzed and was confirmed to be an organosilicon compound (monomer (3)) having the following structure:

monomer (3)

$$(HO)_3Si(CH_2)_3OCH_2\underset{\underset{OH}{|}}{CH}-CH_2SO_3Na$$

Monomer (3) was found to be relatively stable in aqueous solution. Infrared absorption spectroscopy confirmed that monomer (3) contained a salt structure ($-SO_3^-Na^+$), that is, that the desired polyelectrolyte had been obtained. An aqueous polyelectrolyte solution was prepared by diluting monomer (3) to the 30 weight % aqueous solution and then adding to this solution a hydroxyl-terminated polyethylene glycol having an average molecular weight of 400 (Polyethylene Glycol 400 from Wako Junyaku Kogyo Kabushiki Kaisha) at 25 weight % based on monomer (3). Condensation polymerization and particle formation were conducted simultaneously by spray drying this aqueous solution under the following conditions. spray formation: atomizer method air pressure: 1.5 kg/cm$^2$ temperature at spray point: approximately 200° C.

temperature at collection point: approximately 100° C.

Approximately 15 g of a powder was obtained as the result of feeding 100 g of the aqueous polyelectrolyte solution over a period of approximately 10 minutes. This powder was confirmed by microscopic observation to be spherical with an average particle diameter of approximately 2 to 3 micrometers (water content=approximately 5%). After spray drying, this powder was dried for 4 hours in a nitrogen current at 140° C., during which time the weight loss was approximately 5%. Immediately after drying, the powder was physically dispersed to homogeneity at a concentration of 33 weight % in dimethylpolysiloxane oil (SH200-20CS from Dow Corning Toray Silicone Company, Limited) to afford a dispersion designated as the electroviscous fluid. When this electroviscous fluid was allowed to stand at room temperature, 4 to 5 days were required for the solids to begin to sediment, which confirmed the dispersion stability to be relatively good. The electroviscosity of this electroviscous fluid was measured with the following results: yield value=140 Pa at a field strength of 1 kV/mm, yield value=205 Pa at a field strength of 2 kV/mm. The current density at a 1 kV/mm field strength was extremely low at approximately 15 nA/cm$^2$. In addition, the cup filled with this electroviscous fluid was subjected to continuous rotation at a constant shear rate of 300 s$^{-1}$ for 24 hours, and the fluid was then drained off. In terms of appearance, no trace of abrasion was observed on either item when the aluminum rotor and cup were inspected visually. These measurement results are summarized in Table II.

Example 5

The electroviscous fluid prepared in Example 4 was heat aged by immersion for 24 hours open to the atmosphere in an oil bath at 100° C. The appearance of the fluid was unchanged by this ageing. 4 to 5 days were again required for the solids to begin to sediment when this aged electroviscous fluid was held at room temperature, which confirmed that the fluid had retained its good dispersion stability. The electroviscosity of this electroviscous fluid was measured with the following results: yield value=140 Pa at a 1 kV/mm field strength and yield value=205 Pa at a 2 kV/mm field strength. The current density was extremely low, being approximately 20 nA/cm$^2$ at a 1 kV/mm field strength. The cup filled with this electroviscous fluid was also subjected to continuous rotation at a constant shear rate of 300 s$^{-1}$ for 24 hours, and the fluid was drained off. In terms of appearance, no trace of abrasion was observed on either item when the aluminum rotor and cup were visually inspected. These measurement results are summarized in Table II below.

Example 6

10.0 g 3-glycidoxypropyltrimethoxysilane and 5.08 g calcium sulfite were introduced into 15 g pure water and reacted by stirring for 2 hours at 75° C. The reaction mixture was introduced into 100 mL stirred acetone and a white precipitate was produced. This white precipitate was isolated and analyzed and was confirmed to be an organosilicon compound (monomer (4)) having the following structure:

monomer (4)

$$[(HO)_3Si(CH_2)_3OCH_2\underset{\underset{OH}{|}}{CH}-CH_2SO_3]_2Ca$$

Monomer (4) had a fairly poor water solubility, but its suspension in water was relatively stable. Infrared absorption spectroscopy confirmed that monomer (4) contained a salt structure ($[-SO_3^-]_2Ca^{2+}$), that is, that the desired polyelectrolyte had been obtained. An aqueous polyelectrolyte solution was prepared by making up a 30 weight % aqueous suspension of monomer (4) and then adding to this suspension a hydroxyl-terminated polyethylene glycol having an average molecular weight of 400 (Polyethylene Glycol 400 from Wako Junyaku Kogyo Kabushiki Kaisha) at 25 weight % based on monomer (4). Spray drying was then conducted under the same conditions as in Example 4. Approximately 15 g of a powder was obtained as the result of feeding 100 g of the polyelectrolyte suspension over a period of approximately 10 minutes. This powder was confirmed by microscopic observation to be spherical with an average particle diameter of approximately 5 micrometers (water content=2.5%). After spray drying, this powder was dried for 4 hours in a nitrogen current at 140° C., during which time the weight loss was approximately 2.5%. Immediately after drying, this powder was physically dispersed to homogeneity at a concentration of 33 weight % in dimethylpolysiloxane oil (SH200-20CS from Dow Corning Toray Silicone Company, Limited) to afford a dispersion designated as the electroviscous fluid. When this electroviscous fluid was allowed to stand at room temperature, 4 to 5 days were required for the solids to begin to sediment, which confirmed the dispersion stability to be relatively good. The electroviscosity of this electroviscous fluid was measured with the following results: yield value=135 Pa at a field strength of 1 kV/mm, yield value=195 Pa at a field strength of 2 kV/mm. The current density at a 1 kV/mm field strength was extremely low at approximately 5 nA/cm$^2$. In addition, the cup filled with this electroviscous fluid was subjected to continuous rotation at a constant shear rate of 300 s$^{-1}$ for 24 hours, and the fluid was then drained off. In terms of appearance, no trace of abrasion was observed on either item when the aluminum rotor and cup were inspected visually. These measurement results are summarized in Table II.

Example 7

The electroviscous fluid prepared in Example 6 was heat aged by immersion for 24 hours open to the atmosphere in an oil bath at 100° C. The appearance of the fluid was unchanged by this aging. 4 to 5 days were again required for the solids to begin to sediment when this aged electroviscous fluid was held at room temperature, which confirmed that the fluid had retained its good dispersion stability. The electroviscosity of this electroviscous fluid was measured with the following results: yield value=135 Pa at a 1 kV/mm field strength and yield value=190 Pa at a 2 kV/mm field strength. The current density was extremely low, being approximately 10 nA/cm$^2$ at a 1 kV/mm field strength. The cup filled with this electroviscous fluid was also subjected to continuous rotation at a constant shear rate of 300 s$^{-1}$ for 24 hours, and the fluid was then drained off. In terms of appearance, no trace of abrasion was observed on either item when the aluminum rotor and cup were visually inspected. These measurement results are summarized in Table II below.

Comparison Example 3

A wet-method silica (Nipsil VN3 from Nippon Silica Kogyo Kabushiki Kaisha) with an average particle size of 18 micrometers was physically dispersed to homogeneity at a concentration of 15 weight % in dimethylpolysiloxane oil (SH200-20CS from Dow Corning Toray Silicone Company, Limited) to afford a dispersion designated as the electroviscous fluid. When this electroviscous fluid was allowed to stand at room temperature, only several hours were required for the solids to begin to sediment. The dispersion stability was therefore rated as poor. The electroviscosity of this electroviscous fluid was measured with the following results: yield value=65 Pa at a 1 kV/mm field strength and yield value=105 Pa at a 2 kV/mm field strength. The current density was approximately 85 nA/cm$^2$ at a 1 kV/mm field strength. In addition, the cup filled with this electroviscous fluid was subjected to continuous rotation at a constant shear rate of 300 s$^{-1}$ for 24 hours, and the fluid was then drained off. When the aluminum rotor and cup were examined, several wear streaks were observed extending along the direction of rotation. These measurement results are summarized in Table II.

Comparison Example 4

The electroviscous fluid prepared in Comparison Example 3 was heat aged by immersion for 24 hours open to the atmosphere in an oil bath at 100° C. The appearance of the fluid was unchanged by this aging. The dispersion stability at room temperature of the aged electroviscous fluid was on the same level as before ageing. The electroviscosity of this electroviscous fluid was measured with the following results: yield value=5 Pa at a 1 kV/mm field strength and yield value=10 Pa at a 2 kV/mm field strength. The current density was extremely low, being approximately 20 nA/cm$^2$ at a 1 kV/mm field strength. The cup filled with this electroviscous fluid was also subjected to continuous rotation at a constant shear rate of 300 s$^{-1}$ for 24 hours, and the fluid was then drained off. In terms of appearance, traces of abrasion were observed on the aluminum rotor and cup when they were visually inspected. These measurement results are summarized in Table II below.

Comparison Example 5

A weakly acidic spherical acrylic cation-exchange resin (Amberlite IRC-76 from Organo Kabushiki Kaisha) was physically dispersed to homogeneity at a concentration of 10 weight % in dimethylpolysiloxane oil (SH200-20CS from Dow Corning Toray Silicone Company, Limited) to afford a dispersion that was designated as the electroviscous fluid. When this electroviscous fluid was allowed to stand at room temperature, only several hours were required for the solids to begin to sediment. The dispersion stability was therefore rated as poor. The electroviscosity of this electroviscous fluid was measured with the following results: yield value=3 Pa at a 1 kV/mm field strength and yield value=12 Pa at a 2 kV/mm field strength. The current density was approximately 2 nA/cm$^2$ at a 1 kV/mm field strength. In addition, the cup filled with this electroviscous fluid was subjected to continuous rotation at a constant shear rate of 300 s$^{-1}$ for 24 hours, and the fluid was then drained off. In terms of appearance, no trace of abrasion was observed on either item when the aluminum rotor and cup were inspected. These measurement results are summarized in Table II below.

Comparison Example 6

The electroviscous fluid prepared in Comparison Example 5 was heat aged by immersion for 24 hours open to the atmosphere in an oil bath at 100° C. The appearance of the fluid was unchanged by this aging. The dispersion stability at room temperature of the aged electroviscous fluid was on the same level as before aging. The electroviscosity of this electroviscous fluid was measured with the following results: the yield value was below the detection limit at field strengths of 1 kV/mm and 2 kV/mm. The current density was extremely low, being approximately 1 nA/cm$^2$ at a 1 kV/mm field strength. The cup filled with this electroviscous fluid was also subjected to continuous rotation at a constant shear rate of 300 s$^{-1}$ for 24 hours, and the fluid was then drained off. In terms of appearance, no trace of abrasion was observed on either item when the aluminum rotor and cup were visually inspected. These measurement results are summarized in Table II below.

TABLE II

| | Yield Value (Pa) | | Dispersion | |
|---|---|---|---|---|
| | 1 kV/mm | 2 kV/mm | Stability | Abrasion |
| Example 4 | 140 | 205 | excellent | none |
| Example 5 | 140 | 205 | excellent | none |
| Example 6 | 135 | 195 | excellent | none |
| Example 7 | 135 | 190 | excellent | none |
| Comparison Example 3 | 65 | 105 | poor | present |
| Comparison Example 4 | 5 | 10 | poor | present |
| Comparison Example 5 | 3 | 12 | poor | none |
| Comparison Example 6 | below detection limit | | poor | none |

It should be apparent from the foregoing that many other variations and modifications may be made in the compounds, compositions and methods described herein without departing substantially from the essential features and concepts of the present invention. Accordingly it should be clearly understood that the forms of the invention described herein are exemplary only and are not intended as limitations on the scope of the present invention as defined in the appended claims.

That which is claimed is:

1. An electroviscous fluid composition comprising:

(I) an electrical insulating fluid selected from the group consisting of dibutyl sebacate, fluorine oils, and silicone oils; and (II) an organopolysiloxane compound having the unit formula:

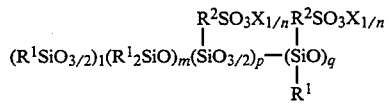

wherein $R^1$ is $C_{1-20}$ alkyl or aryl; $R^2$ is $C_{1-20}$ alkylene; X is a monovalent or divalent metal ion; l, m, p, and q are zero or greater than zero; and n is 1 or 2; with the proviso that p and q cannot simultaneously be zero.

2. A composition according to claim 1, wherein the silicone oil is a diorganopolysiloxane oil.

3. A composition according to claim 2, wherein the diorganopolysiloxane oil is a compound having the formula

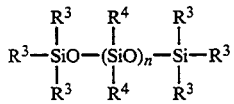

wherein $R^3$ and $R^4$ are monovalent substituted or unsubstituted hydrocarbon groups, and a has an average value of from 1 to 1,000.

4. A composition according to claim 3, wherein $R^3$ and $R^4$ are selected from the group consisting of alkyl groups, and aryl groups.

5. A composition according to claim 3, wherein $R^3$ and $R^4$ are selected from the group consisting of methyl and gamma, gamma, gamma-trifluoropropyl.

6. A composition according to claim 1, wherein X is an ion selected from the group consisting of calcium ion and sodium ion.

7. A method of using an electrorheological fluid composition which comprises applying an external electric voltage to the electrorheological fluid composition, the improvement comprising using as the electrorheological fluid the composition of claim 1.

8. An electroviscous fluid composition comprising:

(I) an electrical insulating fluid selected from the group consisting of mineral oils, dibutyl sebacate, chloroparaffins, fluorine oils, and silicone oils;

(II) an organopolysiloxane compound having the unit formula

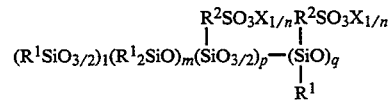

wherein $R^1$ is $C_{1-20}$ alkyl or aryl, $R^2$ is $C_{1-20}$ alkylene, X is a monovalent or divalent metal ion, l, m, p, and q are zero or greater than zero, and n is 1 or 2 with the proviso that p and q cannot simultaneously be zero; and (III) a polyether.

9. A composition according to claim 8, wherein the polyether is a hydroxyl-terminated polyether.

10. A composition according to claim 9, wherein the hydroxyl-terminated polyether is a hydroxyl-terminated polyethylene glycol.

11. A composition according to claim 8, wherein the silicone oil is a diorganopolysiloxane oil.

12. A composition according to claim 11, wherein the diorganopolysiloxane oil is a compound having the formula

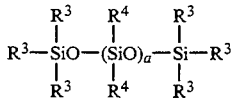

wherein $R^3$ and $R^4$ are monovalent substituted or unsubstituted hydrocarbon groups, and a has an average value of from 1 to 1,000.

13. A composition according to claim 12, wherein $R^3$ and $R^4$ are selected from the group consisting of alkyl groups, and aryl groups.

14. A composition according to claim 12, wherein $R^3$ and $R^4$ are selected from the group consisting of methyl and gamma, gamma, gamma-trifluoropropyl.

15. A method of using an electrorheological fluid composition which comprises applying an external electric voltage to the electrorheological fluid composition, the improvement comprising using as the electrorheological fluid the composition of claim 8.

* * * * *